United States Patent [19]

Brodbeck et al.

[11] 4,011,678

[45] Mar. 15, 1977

[54] SAFETY SYSTEM FOR FIREARM

[75] Inventors: Eduard Brodbeck, Beringen, Switzerland; Theobald Förster, Hohentengen, Germany

[73] Assignee: SIG Schweizerische Industrie-Gesellschaft, Germany

[22] Filed: May 20, 1976

[21] Appl. No.: 688,340

[30] Foreign Application Priority Data

June 27, 1975 Germany ..... 2528831

[52] U.S. Cl. ..... 42/70 F

[51] Int. Cl.[2] ..... F41C 17/04

[58] Field of Search ..... 42/70 R, 70 F, 70 G

[56] References Cited

UNITED STATES PATENTS 3,724,113 4/1973 Ludwig ..... 42/70 F

*Primary Examiner*—Stephen C. Bentley

*Attorney, Agent, or Firm*—Kenway & Jenney

[57] ABSTRACT

A safety mechanism to prevent the accidental discharge of a firearm such as an automatic pistol when the firearm impacts on a hard surface utilizes a second spring loaded slide bolt as an impact safety in addition to a conventional, trigger-activated spring biased slide bolt. The second safety bolt and its bias spring are structured and located so that an impact which causes the trigger-activated safety bolt to move out of its normal "safety-on" position also causes the second slide to move against its bias spring to engage a recess on a firing pin and thereby prevent the weapon from firing. Also, when the firing pin is located in a slide of an automatic pistol, the slide, firing pin and hammer are structured so that a movement of the slide on impact towards the hammer causes the rear edge of the slide to strike the hammer with the firing pin spaced from the hammer.

4 Claims, 3 Drawing Figures

SAFETY SYSTEM FOR FIREARM

BACKGROUND OF THE INVENTION

This invention relates in general to firearms and more particularly to safety mechanisms for automatic hand firearms.

Safety mechanism to prevent the accidental discharge of a firearm are well known in the art. One type of safety is a bolt that slides transversely to the longitudinal axis of a firing pin and is adapted to engage a recess formed on the firing pin. The safety bolt is spring biased to engage the recess and thereby block a longitudinal movement of the firing pin. A safety release mechanism, activated when a trigger is pulled to fire the weapon, pushes the safety bolt out of the recess to release the firing pin just prior to firing.

While such safety mechanisms are reliable during normal handling of a weapon, they can fail to prevent an accidental discharge of a shot when the weapon falls and strikes a hard surface or is otherwise subjected to an impact. More specifically, an accidental discharge is likely to occur when the weapon has an orientation on impact such that one component of the impact force drives the safety member out of the recess on the firing pin while at the same time a second component of the impact force drives the striking pin forward against a priming cap of a cartridge. The forward movement of the firing pin can be direct, or through a backward movement of a slide which carries the firing pin against the hammer.

It is therefore a principal object of this invention to provide a reliable safety system that prevents the accidental discharge of a firearm due to an impact that releases another safety device that is normally positioned to block a forward movement of the firing pin.

Another object of the invention is to provide an impact safety system that prevents the firing pin from striking the hammer through movement on impact of a slide carrying the firing pin.

A further object of this invention is to provide a safety mechanism that achieves these objects while being rugged and having a relatively low cost of manufacture.

SUMMARY OF THE INVENTION

An "impact" safety bolt is provided that slides in a direction transverse to the longitudinal axis of a firing pin. A bias spring urges the impact safety bolt to a position that is clear of the firing pin during normal handling and use. The impact safety bolt and its bias spring are structured and oriented so that an impact that disengages a similar spring-biased main safety from its normal blocking position, and causes a longitudinal movement of the firing pin that can fire a cartridge, also drives the impact safety against its bias spring to engage a recess on the firing pin and block its movement. Preferably the safety bolts are slide pieces that move generally perpendicular to the firing pin. Also in a preferred form, the "main" safety engages a recess formed on an upper surface of the firing pin, and the "impact" safety engages a recess formed on a lower surface of the firing pin. In a firearm where the firing pin is mounted in a slide capable of movement towards the hammer, the slide, hammer and firing pin are structured and located so that the striking pin is spaced from the hammer by when a rear edge of the slide strikes the hammer.

These and other features and objects of the invention will become apparent to those skilled in the art from the following detailed description to be read in light of the accompanying drawings.

DETAILED DESCRIPTION OF THE PREFERRED EMBODIMENTS

Figure 1:
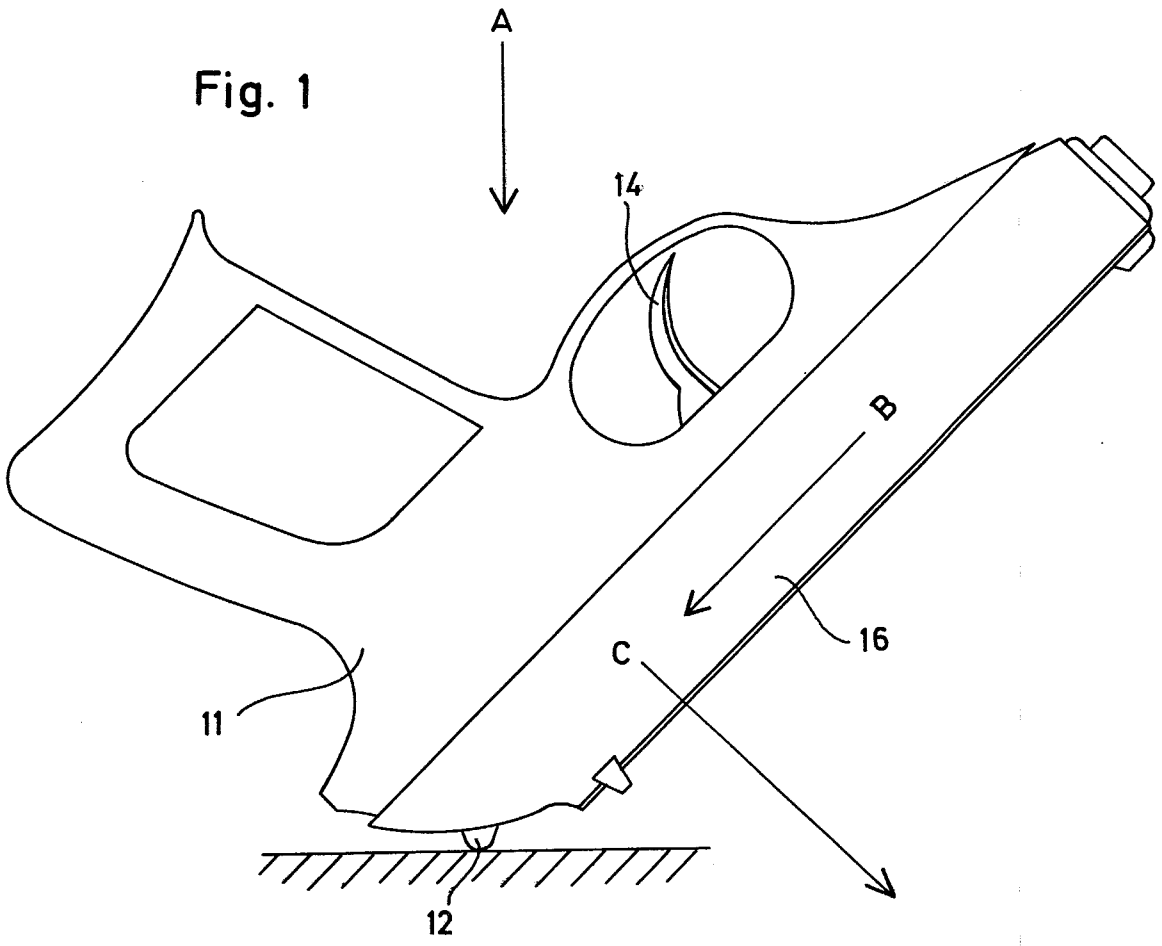
FIG. 1 is a view in side elevation of an automatic pistol that incorporates a preferred embodiment of the invention with the pistol in an oblique orientation as it strikes a hard surface and the firing pin in its forward position.
Figure 3:
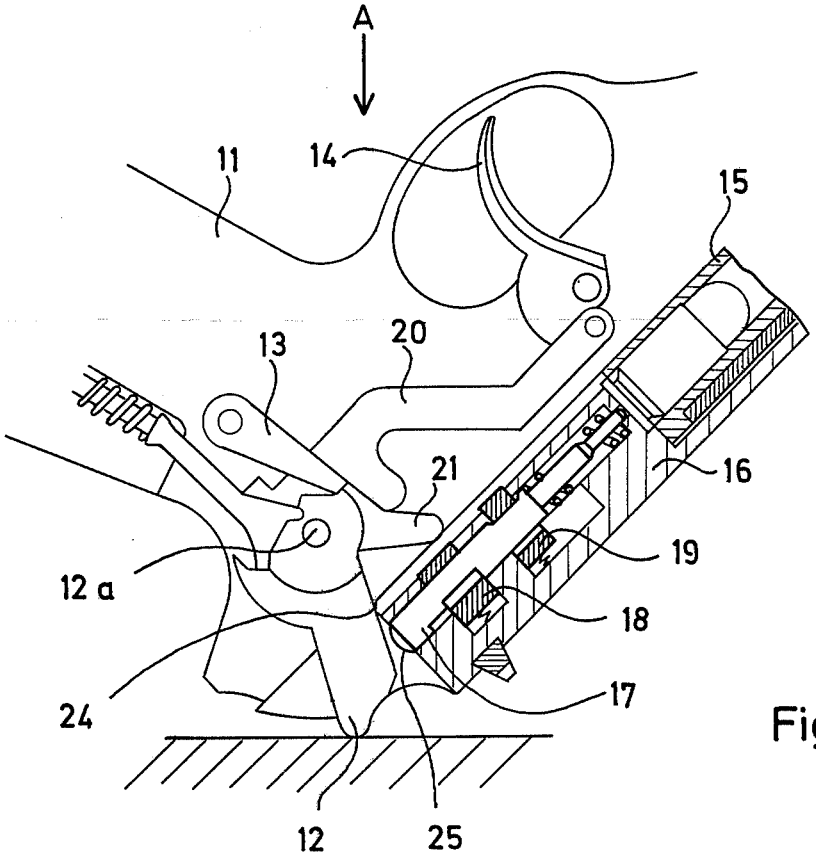
FIG. 3 is a view corresponding to FIGS. 1 and 2 with the safety members thrown into their "impact" positions and the slide thrown back so that its rear edge is in contact with the hammer.
Figure 2:
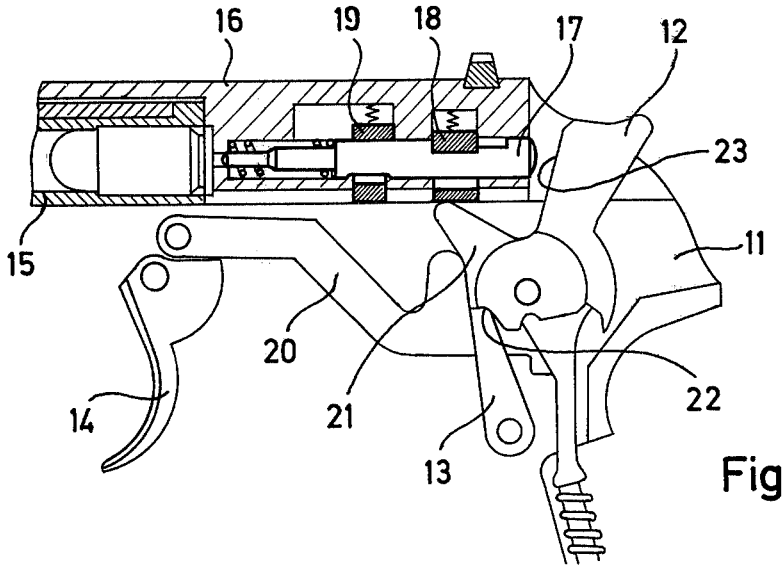
FIG. 2 is a sectional view with portions broken away corresponding to FIG. 1 showing the safety bolts in their normal rest positions.

FIGS. 1–3 illustrate an automatic pistol which incorporates a safety system constructed according to the invention. The pistol has a frame 11 that mounts a slide 12, a catch lever 13 and a trigger 14. A barrel 15 is secured to the frame 11 by any suitable means such as a press fit. Within the slide 16 are mounted a firing pin 17 and two spring loaded safety bolts or slides 18 and 19 which act independently of one another. The firing pin has its longitudinal axis aligned generally in the direction indicated by the arrow B in FIG. 1. The safety slides 18 and 19 are movable in a second direction generally transverse to the longitudinal axis of the firing pin 17 and indicated by the arrow C in FIG. 1.

The slide 16 is supported on the frame 11 so that the gas pressure developed when a round is fired causes the slide to move in the direction of the arrow B against the force of a recoil spring (not shown). This backward recoil movement of the slide is used to eject the cartridge case of the fired round and to cock the firing mechanism. When the slide returns to its forward position (FIGS. 1 and 2) it loads a new cartridge from a magazine (not shown) into the barrel.

The trigger 14 is connected by means of a trigger arm 20 to the hammer 12, the catch lever 13, and a safety releasing lever 21 that acts on the safety bolt 18. The releasing lever 21 and the hammer 12 are mounted on a common axel 12*a*.

In operation, as the trigger 14 is drawn to the rear to fire the pistol (the hammer 12 being cocked), the trigger arm 20 pushes the release lever 21 upwardly which in turn pushes the safety bolt 18 upwardly out of a recess formed on the upper surface of the firing pin 17. After the trigger 14 has moved through a predetermined distance, the releasing lever 21 has pushed the safety bolt 18 against the force of its bias spring, to a point where the bolt is clear of the recess in the firing pin. The firing pin is then released and ready to be driven forward by the hammer 12, against the force of a firing pin spring, to ignite the priming cap of the cartridge in the barrel. Further movement of the trigger allows the catch lever 13 to move forward which in turn allows the cocked hammer 12 to strike the end of the firing pin and drive it forward.

FIG. 1 illustrates a situation in which the pistol is likely to discharge unintentionally through an impact. The pistol has fallen vertically in a direction indicated by the arrow A and the weapon is in an oblique position with respect to the vertical so that the hammer 12 strikes the floor or a similar hard surface. In this situation, the impact of the hammer on the hard surface suddenly brakes the frame 11 and all the parts mounted on it. The slide 16, however, retains a moment of inertia which causes it to execute a backward sliding movement relative to the frame 11 until it strikes the hammer.

Since the direction of movement of the slide 16 is not aligned with the direction of fall of the pistol, the force of the impact has a component in the direction of movement of the slide (arrow B) and a component at right angles to this direction (arrow C). Provided the weapon is dropped from a sufficient height, the component of force in the direction of the arrow C can be sufficient to throw the safety bolt 18 in an upward direction, that is, in the direction of the arrow C, in opposition to its bias spring. This movement on impact therefore moves the safety bolt 18 out of its normal blocking position and releases the firing pin. The firing pin, however, does not move forward to fire the cartridge because the component of force in the direction of the arrow C also simultaneously moves the "impact" safety bolt 19 into a blocking position in which it engages a recess formed on the lower side of the firing pin. The second safety bolt 19 therefore prevents a movement of the firing pin and an accidental discharge of the pistol due to the impact.

In addition to the action of the "impact" safety bolt 19, it is desirable to structure the slide, firing pin, and hammer so that the backward movement of the slide following an impact causes the front face 23 of the hammer to strike the edge 24 of the slide and not the rear end 25 of the firing pin. Given the substantially flat configurations of the striking surface 23 of the hammer and the end surface of the slide 16, this action can be achieved by designing the catch notch 22 on the hammer so that the front face 23 of the hammer is inclined with respect to the end surface of the slide. Accordingly the angle of inclination should be such that the edge 24 of the slide strikes the surface 23 before the end 25 of the firing pin strikes the surface 23.

Although the invention has been described with reference to an automatic pistol, it will be understood that it can be employed in other weapons where a safety member can move out of its blocking position due to a sudden impact. Further, although the invention has been described with respect to safety members in the form of spring-biased slide bolts, it will be understood that other safety members having a different configuration or mode of movement can be employed. These and other modifications will become apparent to those skilled in the art from the foregoing description and the accompanying drawings. Such modifications are intended to fall within the scope of the appended claims.

What is claimed is:

1. A safety mechanism for firearms having a firing pin movable in a first direction to fire a cartridge and a first spring-loaded safety member movable in a second direction transverse to said first direction between a normal blocking position in which said first safety member engages a first recess formed on the firing pin and a release position in which the safety member is clear of said recess, comprising a second safety member movable between a release position in which said second safety member clears the firing pin and a blocking position in which said second safety member engages a second recess formed on said firing pin, and means for urging said second safety member towards said release position, said urging means and second safety member being structured and located so that an impact which causes said first safety member to move to its release position also causes said second safety member to move to its blocking position to prevent an unintentional firing of the cartridge.

2. A safety mechanism according to claim 1 in which said first recess is formed on the upper surface of said firing pin and said second recess is formed on a lower surface of said firing pin.

3. A safety mechanism according to claim 2 in which said first and second safety members are slide bolts and said urging means is a bias spring acting on an upper surface of the second safety member.

4. A safety mechanism according to claim 1 further comprising a slide movable in the first direction that carries said firing pin and a hammer adapted to strike an end of said firing pin, said slide, hammer and firing pin being structured and located with respect to one another so that movement of the slide towards said hammer is stopped by contact between an edge of said slide and said hammer with said firing pin spaced from said hammer.

* * * * *